US012532927B2

(12) United States Patent
Semling

(10) Patent No.: US 12,532,927 B2
(45) Date of Patent: Jan. 27, 2026

(54) WATCH RECEIVING GLOVE METHOD AND ASSEMBLY

(71) Applicant: Sonja Semling, Fountain City, WI (US)

(72) Inventor: Sonja Semling, Fountain City, WI (US)

( * ) Notice: Subject to any disclaimer, the term of this patent is extended or adjusted under 35 U.S.C. 154(b) by 535 days.

(21) Appl. No.: 17/671,771

(22) Filed: Feb. 15, 2022

(65) Prior Publication Data

US 2023/0255285 A1 Aug. 17, 2023

(51) Int. Cl.
*A41D 19/00* (2006.01)

(52) U.S. Cl.
CPC ..... *A41D 19/0013* (2013.01); *A41D 19/00* (2013.01); *A41D 19/0027* (2013.01)

(58) Field of Classification Search
CPC . A41D 19/00; A41D 19/0013; A41D 19/0027
See application file for complete search history.

(56) References Cited

U.S. PATENT DOCUMENTS 4,387,838 A 6/1983 Jackson
4,761,835 A 8/1988 Chen
4,766,611 A 8/1988 Kim
5,623,731 A 4/1997 Ehrgott
6,519,207 B1 2/2003 Lukacsko
6,611,962 B2 9/2003 Redwood
7,124,447 B2 10/2006 Arganese
7,252,215 B1 * 8/2007 Furnas, II ..... A45C 1/04 224/164
8,677,515 B2 * 3/2014 Ishihara ..... A41D 1/002 2/125
2011/0225703 A1 9/2011 Maple
2015/0185872 A1 * 7/2015 Leto ..... G06F 3/0393 2/167
2018/0110270 A1 * 4/2018 Robbins ..... A41D 19/00
2019/0166933 A1 * 6/2019 Tiffin ..... A41D 19/0013

* cited by examiner

*Primary Examiner* — Khoa D Huynh
*Assistant Examiner* — Giao Qt Hoang

(57) ABSTRACT

A watch receiving glove method and assembly includes a hand covering for covering all fingers, a palm, and a back side of a hand. The hand covering includes at least one finger sleeve and a hand opening for receiving the hand. A wrist covering is attached to and is coextensive with a perimeter edge of the hand opening. The wrist covering comprises a tube for receiving and extending around a wrist of the hand. The tube has a distal edge with respect to the hand covering. The wrist covering includes an upper section is positionable on an upper side of the wrist and lower section is positionable on a bottom side of the wrist. The wrist covering has a display opening extending therethrough. A display case is positionable in the display opening when a strap attached to the display case is extended around the wrist.

3 Claims, 5 Drawing Sheets

WATCH RECEIVING GLOVE METHOD AND ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to watch supporting glove device and more particularly pertains to a new watch supporting glove device for allowing a person to wear a more conventional glove which receives a generally conventional wrist watch, or wrist watch type device, such that the wrist watch display is viewable without having to lift a glove wrist cuff off of the display. Today's watches are often smart watches or fitness tracking devices having the ability to monitor a person during the performance of exercises. While the information provided is valuable to the person, when a person is exercising in cold weather and a glove or mitten is desired for comfort there is a problem with being able to view the display since it is typically covered by the cuff of the glove. Thus, a need is presented whereby a person can easily view the display without having to reach across their body, while exercising, to lift the cuff to expose the display and, subsequently, the adjacent areas of their skin. Additionally, in some cases it would be advantageous to allow abutment between the user's skin and the smart watch/fitness tracking device to facilitate biometric data transfer from the user's skin.

(2) Description of Related Art Including Information Disclosed Under 37 CFR 1.97 and 1.98

The prior art relates to watch supporting glove devices that typically include a watch housing that is mechanically coupled to a glove for viewing.

BRIEF SUMMARY OF THE INVENTION

An embodiment of the disclosure meets the needs presented above by generally comprising a hand covering for covering all fingers, a palm, and a back side of a hand. The hand covering includes at least one finger sleeve and a hand opening for receiving the hand. A wrist covering is attached to and is coextensive with a perimeter edge of the hand opening. The wrist covering comprises a tube for receiving and extending around a wrist of the hand. The tube has a distal edge with respect to the hand covering. The wrist covering includes an upper section is positionable on an upper side of the wrist and lower section is positionable on a bottom side of the wrist. The wrist covering has a display opening extending therethrough. A display case is positionable in the display opening when a strap attached to the display case is extended around the wrist.

A method encompassing embodiment includes placing a hand covering on the hand such that fingers, a palm, and a back side of the hand are each covered by the hand covering. The hand covering includes at least one finger sleeve. The wrist is covered with a wrist covering attached to and coextensive with a perimeter edge of a hand opening that extends into the hand covering. The wrist covering comprises a tube for receiving and extending around a wrist of the hand. The tube has a distal edge with respect to the hand covering. The wrist covering includes an upper section positionable on an upper side of the wrist and lower section positionable on a bottom side of the wrist. The wrist covering includes an inner layer configured for abutting against the wrist and an outer layer defining an exterior of the wrist covering. An interior space is defined between the inner layer and the outer layer, wherein the inner and outer layers are attached to each other along distal edge. A display case is positioned in a display opening extending through the outer layer and a strap attached to the display case is extended into the interior space between the inner and outer layers.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
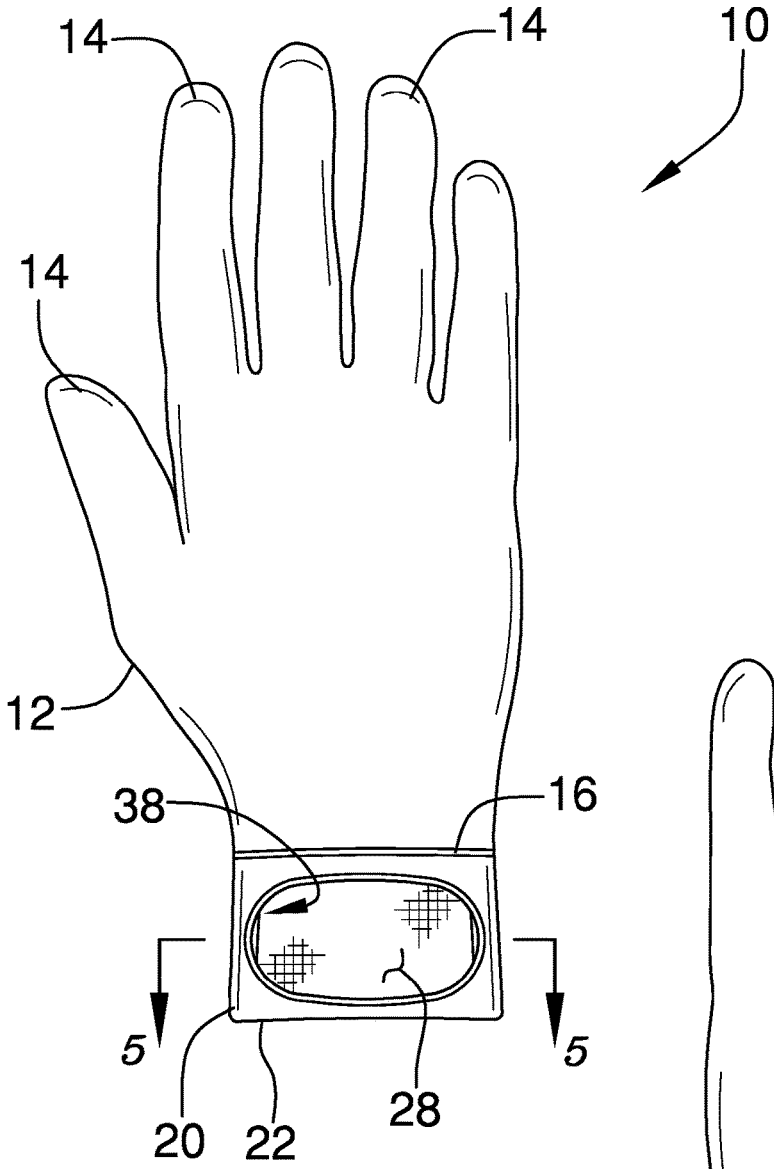
FIG. 1 is a top view of a watch receiving glove method and assembly according to an embodiment of the disclosure.
Figure 2:
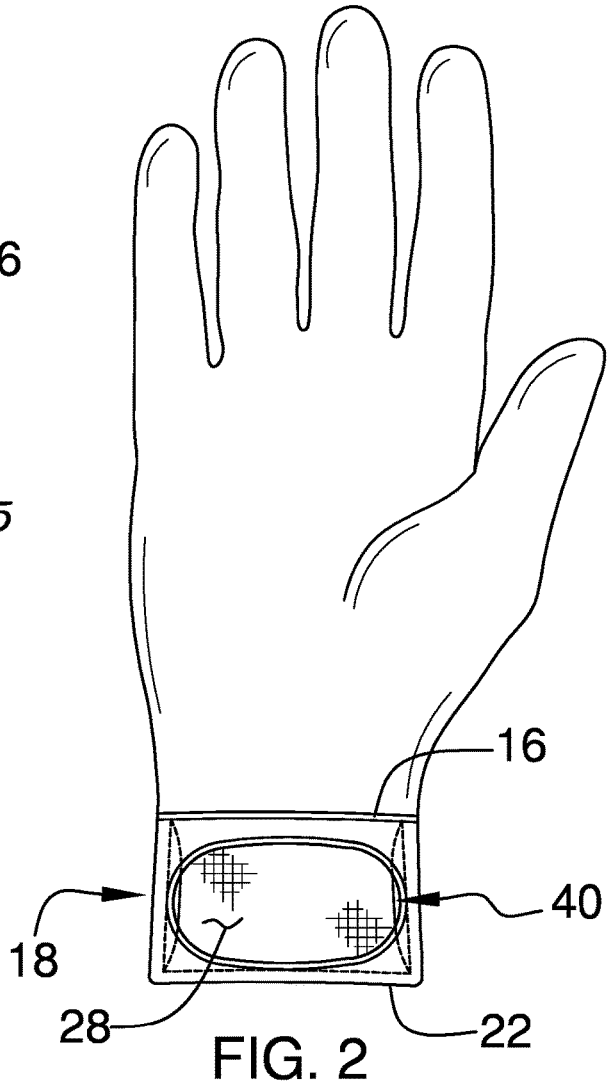
FIG. 2 is a bottom view of an embodiment of the disclosure.

With reference now to the drawings, and in particular to FIGS. 1 through 8 thereof, a new watch supporting glove device embodying the principles and concepts of an embodiment of the disclosure and generally designated by the reference numeral 10 will be described.

As best illustrated in FIGS. 1 through 8, the watch receiving glove method and assembly 10 generally comprises a hand covering 12 for covering all fingers, a palm, and a back side of a hand. The hand covering 12 includes at least one finger sleeve 14 and further includes a hand opening 16 for receiving the hand. Though the hand opening 16 is not directly viewable in the figures, the area marked "16" in FIGS. 1 and 2 defines a perimeter of the hand opening 16. It should be understood that the hand covering 12 is not limited to gloves. The hand covering 12 may comprise a conventional glove having five finger sleeves 14 or may include a mitten with one large chamber for receiving four fingers and one finger sleeve to receive a person's thumb. The hand covering 12 may be comprised of any conventional cloth material, natural or synthetic, utilized for gloves and mittens and may further include insulation materials.

A wrist covering 18 is attached to and is coextensive with a perimeter edge of the hand opening 16. The wrist covering 18 may form a unitary structure with the hand covering 12 or may be a separate structure that is, typically, non-removably attached to the hand covering 12. The wrist covering 18 comprises a tube 20 for receiving and extending around a wrist of the hand. While the wrist covering 18 may comprise the same types of materials used for the hand covering 12, the wrist covering 18 may be comprised of other materials. As an example, while the hand covering 12 might include non-stretchable materials, the wrist covering 18 may comprise resiliently elastic materials. This does not limit the materials of the hand covering 12 as the hand covering 12 also may be comprised of stretchable and resiliently elastic materials. The tube 20 has a distal edge 22 with respect to the hand covering 12 and will form the opening for receiving the person's hand. The wrist covering 18 includes an upper section 24 that is positionable on an upper side of the wrist and lower section 26 is positionable on a bottom side of the wrist.

Figure 3:
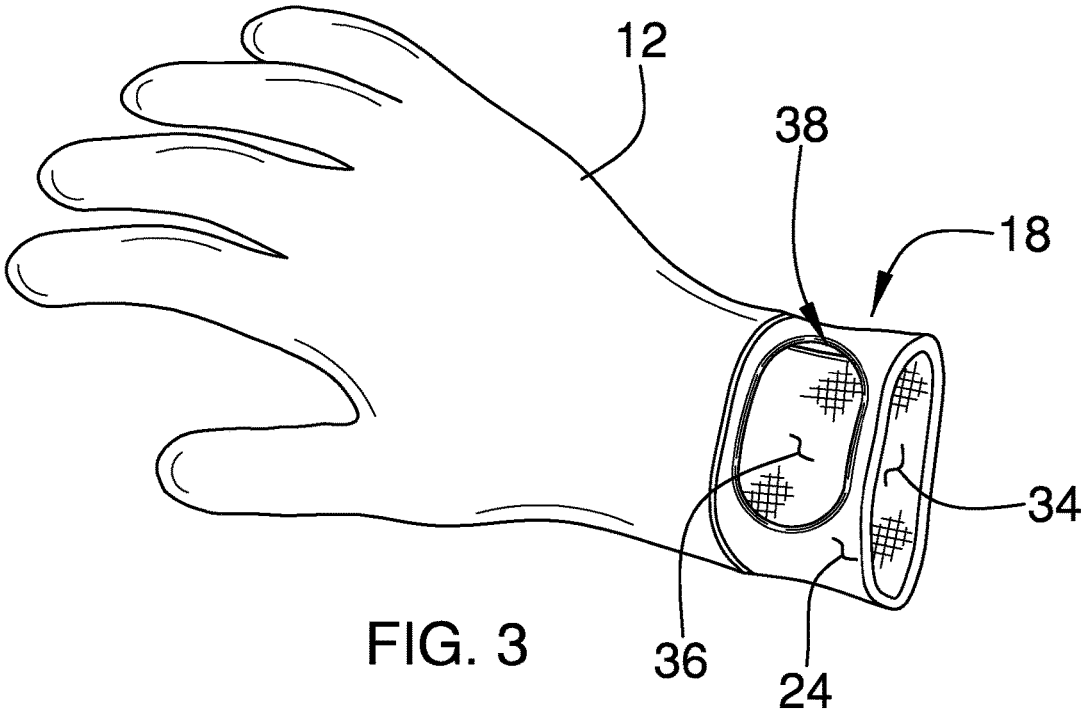
FIG. 3 is a top isometric view of an embodiment of the disclosure.
Figure 4:
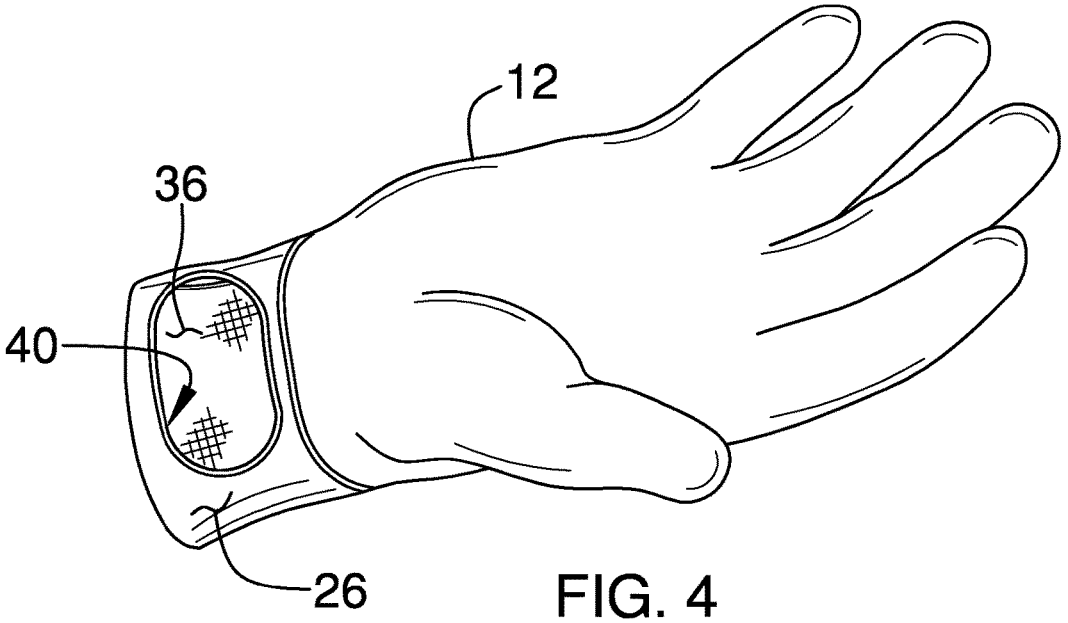
FIG. 4 is a bottom isometric view of an embodiment of the disclosure.
Figure 5:
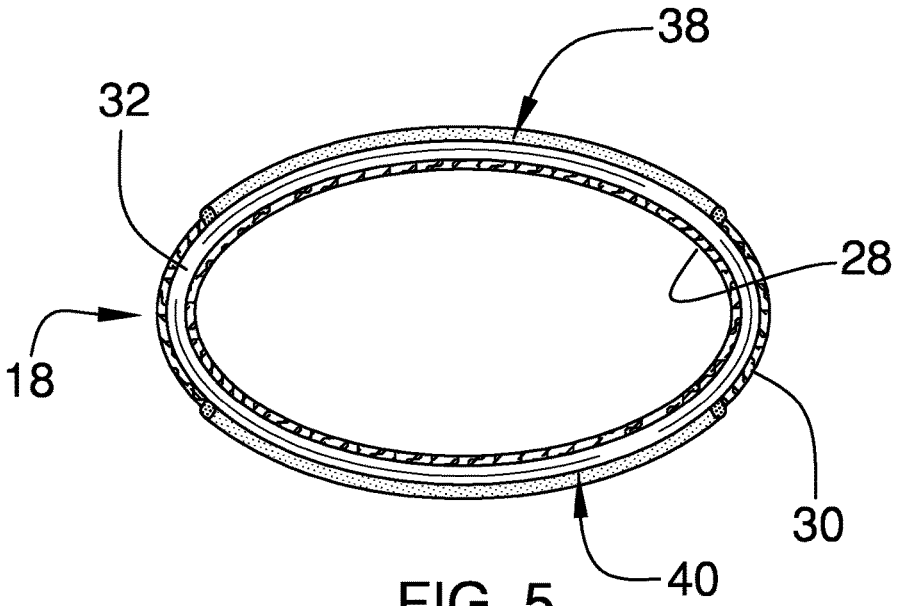
FIG. 5 is a cross-sectional view of an embodiment of the disclosure taken along line 5-5 of FIG. 1.
Figure 6:
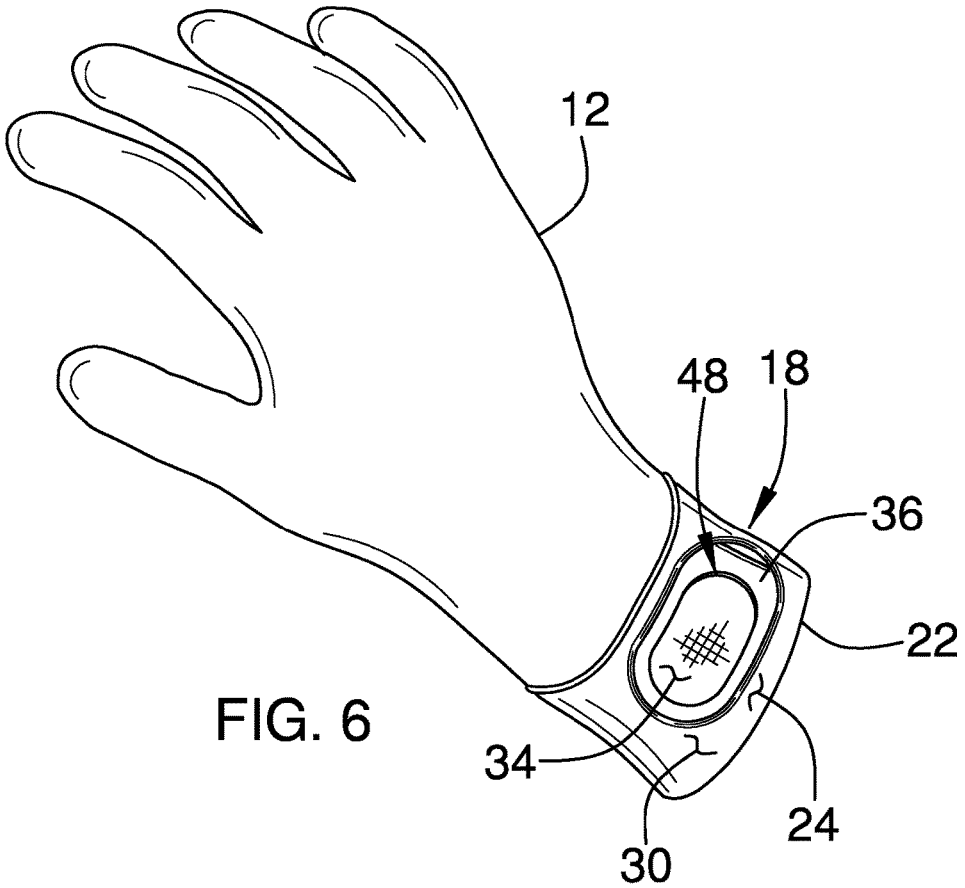
FIG. 6 is a top view of an embodiment of the disclosure.
Figure 7:
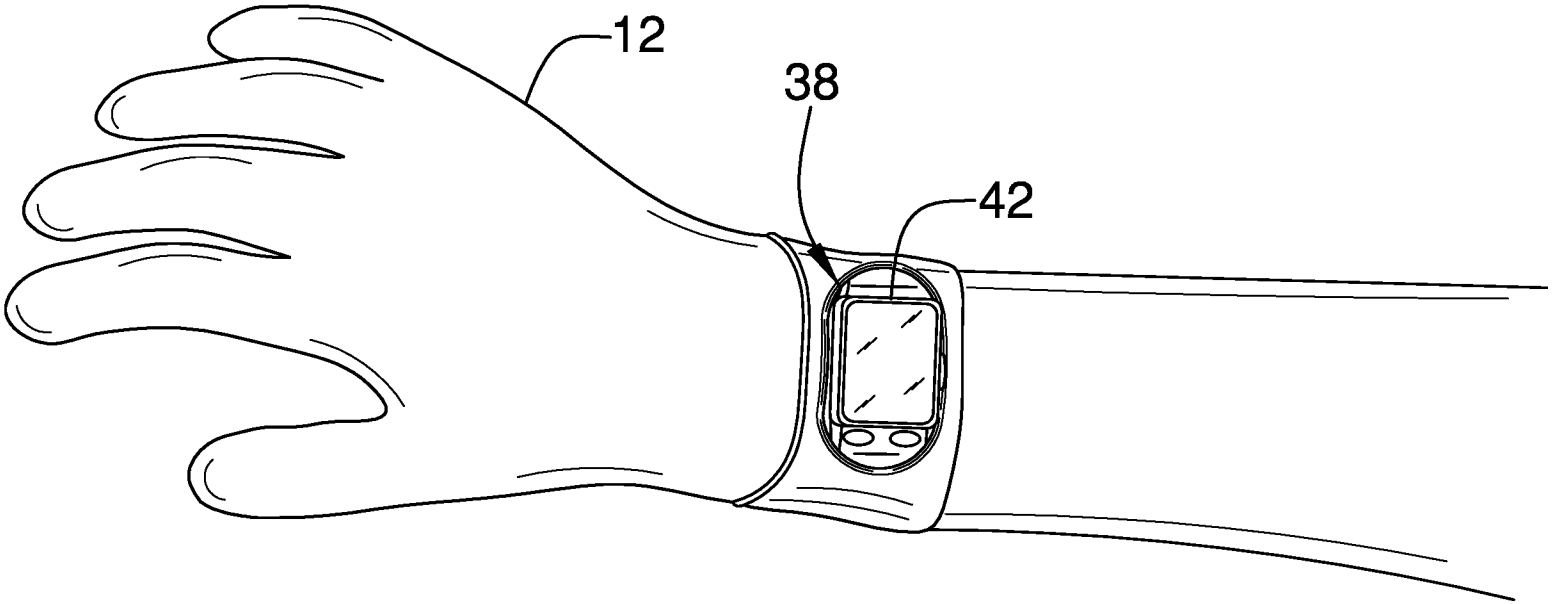
FIG. 7 is a top isometric in-use view of an embodiment of the disclosure.
Figure 8:
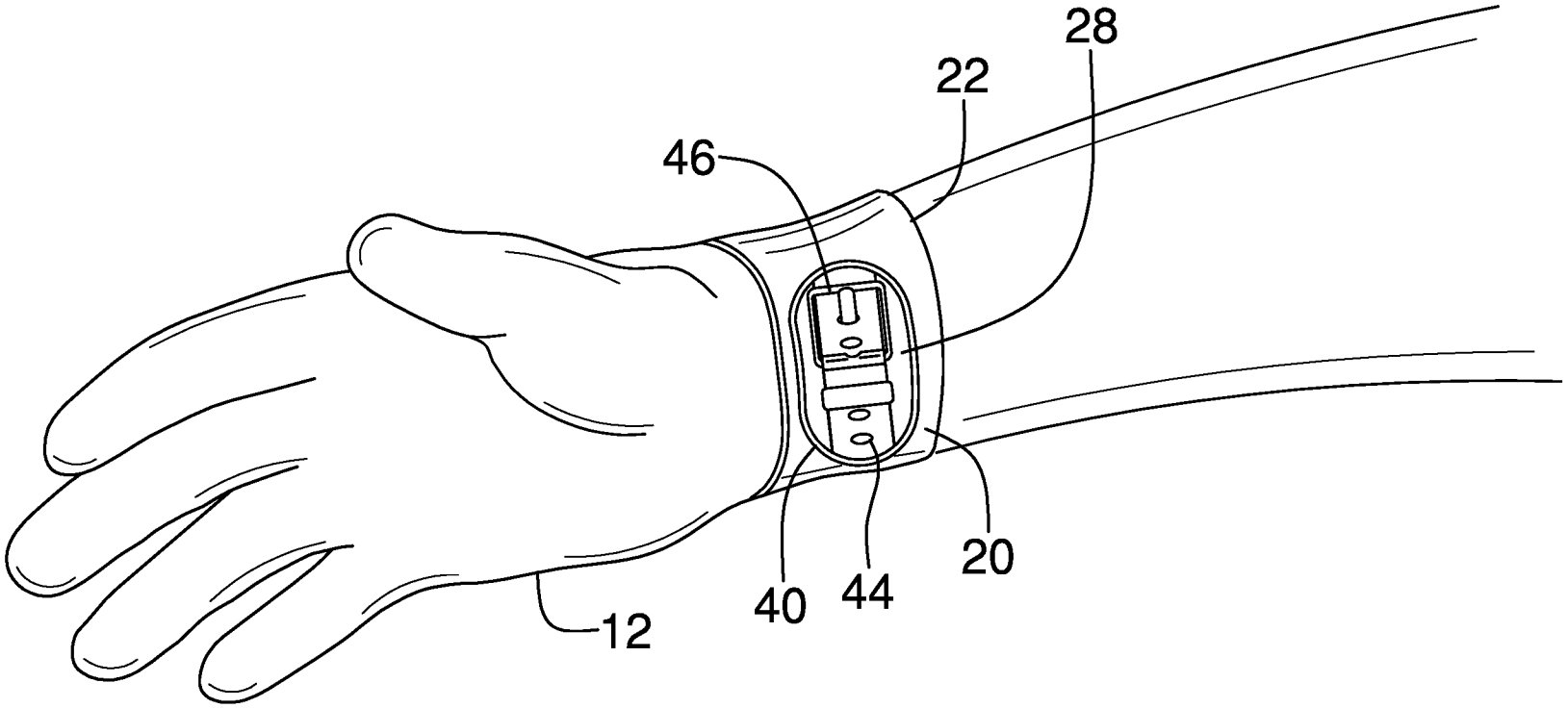
FIG. 8 is a bottom isometric in=use view of an embodiment of the disclosure.

More particularly, the wrist covering 18 may include an inner layer 28 configured for being abutted against the wrist and an outer layer 30 defining an exterior of the wrist covering 18. An interior space 32 is defined between the inner layer 28 and the outer layer 30. Typically, the inner 28 and outer 30 layers are attached to each other along distal edge 22. The inner 28 and outer 30 layers may be attached together adjacent to the hand covering 12 or each may be attached independently to the hand covering 12. For clarification, as shown in FIGS. 3, 4, and 6, the inner 28 layer includes an abutment side 34 that is abutted against a user's skin and an inner side 36 opposite the abutment side 34.

The outer layer 30 has a display opening 38 extending therethrough. In one embodiment, the display opening 38 is positioned in the upper section 24, though, for reasons which will become clear below, the display opening 38 may be positioned in the lower section 26. In some embodiments, the outer layer 30 has a strap opening 40 extending therethrough that is positioned in the lower section 26 and opposite of the display opening 38.

A display case 42 is positionable in the display opening 38 and a strap 44 attached to the display case 42 is extendable through the interior space 32 such that the strap 44 is accessible through the strap opening 40. Thus, it should be understood that a user may switch the orientation of the display case 42 such that it is visible and exposed through the strap opening 40 and that the strap 44 is visible and exposed through the display opening 38.

The display case 42 and strap 44 may comprise one of multiple wrist mounted assemblies to be worn by a person. Though the title of the invention includes the display case being a watch, such was for explanation purposes only and the invention is not limited to usage with watches. Thus, the display case 42 may include any wrist worn body encasing mechanical, electrical, or electromechanical devices to be worn by a person. Examples may include mechanical watch housings and their conventional components, electronic watches, smart watches, GPS tracking assemblies, biometric measuring systems, and combinations thereof. Smart watches are ubiquitous and include features such providing and tracking the time, communicating with others, monitoring a person's location, and tracking biometric statistics such as heart rate, blood pressure, blood oxygen saturation, and calories consumed, for example. Thus, while the wrist covering 18 is not only for usage with smart watches, one particularly advantageous usage of the wrist covering 18 is for persons exercising in cold weather who prefer being able to cover their hands while also being able to easily view relevant information such as current time, location, and statistics related to an exercise activity. In some embodiments, not shown, the display opening 38 may be closed with a clear covering to allow for viewing through the display opening 38 while protecting the display case 42 and thus will protect the display case 42. The clear covering would typically be comprised of a flexible plastic though rigid materials may also be utilized. However, the clear covering would only be utilized when there would be no reason to physically interact with display case 42 through the display opening 38. Therefore, when the display case 42 include a touch screen, the clear covering would not be preferred.

In one embodiment, such as shown in FIG. 6, the wrist covering 18 further includes a biometric opening 48 extending through the inner layer 28 and is aligned with the display opening 40. The biometric opening 48 allows for the display case 42 to abut a person's skin to facilitate interaction between the person and the display case 42 for retrieval of biometric data.

In use, a person will wear the hand 12 and wrist 18 coverings as they would a conventional glove. The hand covering 12 and wrist covering 18 will be comprised of conventional materials used for gloves and mittens and may be tailored for specific requirements based on weather and comfort. A user would typically extend a strap 44, having two strap components, into the display opening 38 such that the strap components extend into the internal space 32, to the left and the right of the display opening 38, such that the display case 42 is seated in the display opening 38. The strap components will be accessible through the strap opening 40 such that a connector 46 is accessible through the strap opening 40 to secure together the strap components. The "connector" may comprise any conventional mechanical structure for securing together or tightening strap components together on a person's wrist including clasps, hook and loop securing members, magnets and the like. In embodiments where the biometric opening 48 is utilized, the display case 42 is placed in abutment with the user's skin. Consequently, the user will have their hand covered in a typical manner while being able to see and access a face of the display case 42 to retrieve any desired information therefrom or, in the case with wirelessly equipped smart watches, to communicate with other people.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A handwear assembly configured for receiving a combination band and display apparatus, the assembly comprising: a hand covering for covering all fingers, a palm, and a back side of a hand, the hand covering including at least one linger sleeve, the hand covering including a hand opening for receiving the hand; and a wrist covering being attached to and being coextensive with a perimeter edge of the hand opening, the wrist covering comprising a tube for receiving and extending around a wrist of the hand, the tube having a distal edge with respect to the hand covering, the wrist covering including an upper section being positionable on an upper side of the wrist and lower section being positionable on a bottom side of the wrist, the wrist covering having a display opening extending therethrough, wherein a display case is positionable in the display opening when a strap attached to the display case is configured to extend around the wrist, wherein the wrist covering includes: an inner layer configured for being abutted against the wrist; an outer layer defining an exterior of the wrist covering, an interior space being defined between the inner layer and the outer layer, the inner and outer layers being attached to each other along the distal edge, the display opening extending through the outer layer, the strap being positionable in the interior space, wherein the wrist covering includes a strap opening extending therethrough and being positioned opposite of the display opening for accessing the strap through the wrist covering.

2. A method of covering a hand while allowing interaction of a combination band and display apparatus worn adjacent to the hand, the method including the steps of: placing a hand covering on the hand such that fingers, a palm, and a back side of the hand are each covered by the hand covering, the hand covering including at least one finger sleeve; covering the wrist with a wrist covering attached to and being coextensive with a perimeter edge of a hand opening extending into the hand covering, the wrist covering comprising a tube for receiving and extending around a wrist of the hand, the tube having a distal edge with respect to the hand covering, the wrist covering including an upper section being positionable on an upper side of the wrist and lower section being positionable on a bottom side of the wrist, the wrist covering including: an inner layer configured for being abutted against the wrist: an outer layer defining an exterior of the wrist covering, an interior space being defined between the inner layer and the outer layer, the inner and outer layers being attached to each other along the distal edge; and positioning a display case in a display opening extending through the outer layer and extending a strap attached to the display case into the interior space between the inner and outer layers, further including the step of positioning a connector of the strap in a strap opening extending though the outer layer wherein the strap opening is positioned opposite of the display opening.

3. A method of covering a hand while allowing interaction of a combination band and display apparatus worn adjacent to the hand, the method including the steps of: placing a hand covering on the hand such that fingers, a palm, and a back side of the hand are each covered by the hand covering, the hand covering including at least one finger sleeve; covering the wrist with a wrist covering attached to and being coextensive with a perimeter edge of a hand opening extending into the hand covering, the wrist covering comprising a tube for receiving and extending around a wrist of the hand, the tube having a distal edge with respect to the hand covering, the wrist covering including an upper section being positionable on an upper side of the wrist and lower section being positionable on a bottom side of the wrist, the wrist covering including: an inner layer configured for being abutted against the wrist: an outer layer defining an exterior of the wrist covering, an interior space being defined between the inner layer and the outer layer, the inner and outer layers being attached to each other along the distal edge; and positioning a display case in a display opening extending through the outer layer and extending a strap attached to the display case into the interior space between the inner and outer layers, further including the step of positioning a connector of the strap in a strap opening extending though the outer layer wherein the strap opening is positioned opposite of the display opening, further including the step of abutting the display case against the wrist through a biometric opening extending through the inner layer and being aligned with the display opening.

* * * * *